US005125449A

United States Patent [19]

Asao

[11] Patent Number: 5,125,449

[45] Date of Patent: Jun. 30, 1992

[54] IMPROVED MOLDING MACHINE

[75] Inventor: Shozo Asao, Hyogo, Japan

[73] Assignee: Taiyo Chuki Co., Ltd., Osaka, Japan

[21] Appl. No.: 636,885

[22] Filed: Jan. 2, 1991

[51] Int. Cl.[5] ..... B22C 15/24; B22C 15/28

[52] U.S. Cl. ..... 164/195; 164/200

[58] Field of Search ..... 164/195, 200, 29, 38

[56] References Cited

U.S. PATENT DOCUMENTS 4,313,486 2/1982 Kondo et al. ..... 164/195 X

FOREIGN PATENT DOCUMENTS 56-45251 4/1981 Japan ..... 164/195
57-142745 9/1982 Japan ..... 164/200
61-23552 2/1986 Japan ..... 164/195
61-27145 2/1986 Japan ..... 164/38
975184 11/1982 U.S.S.R. ..... 164/200
2057319A 4/1981 United Kingdom ..... 164/200

*Primary Examiner*—J. Reed Batten, Jr.
*Attorney, Agent, or Firm*—Jansson & Shupe, Ltd.

[57] ABSTRACT

The improved molding machine is constructed such that a match plate having molding portions is clamped between upper and lower molding boxes. Molding sand carried by compressed air is introduced into each of the upper and lower molding boxes. Compressed air (which is devoid of sand) is blown from the under side of the lower molding box so that the molding sand may be evenly deposited on the under surface of the molding portions of the match plate.

3 Claims, 7 Drawing Sheets

IMPROVED MOLDING MACHINE

BACKGROUND OF THE INVENTION

1. Field of the Invention

The present invention relates to a molding machine and particularly to such an improved molding machine which comprises upper and lower molding boxes into which a molding sand is shot or injected under pressure so as to form a mold and then the mold is taken out.

2. Description of the Prior Art

Conventionally, such a molding machine is constructed such that an upper molding box and a lower molding box are provided with a machine body to be close and remote from each other in vertical directions and that a match plate having molding portions is provided between the upper and lower molding boxes to be movable in lateral directions.

After the match plate is clamped between the upper and lower molding boxes, molding sand is shot by compressed air into spaces formed by the match plate and the upper and lower molding boxes, and then the molding sand in the upper and lower molding boxes is squeezed in vertical directions to firmly compact it. Then, the upper and lower molding boxes are moved away from each other in vertical directions and the match plate is taken out laterally and then the upper and lower molding boxes are moved close to each other again. Thereafter, the upper and lower molds formed in the upper and lower molding boxes are pushed down and then taken out from the machine body.

The above-mentioned sand shot is carried out by using a blowing opening formed with the side portion of each of the upper and lower molding boxes. Although the molding sand goes into the upper and lower molding boxes together with compressed air, only the compressed air is permitted to escape from the upper and lower molding boxes. For the purpose, a number of air escaping holes are formed with the inside wall of each of the upper and lower molding boxes.

However, in the above mentioned conventional art, the following problems arise in sand shot.

Namely, the molding sand with the compressed air shot into the upper and lower molding boxes, is gradually accumulated on the match plate having molding portions. The molding sand shot into the upper molding box may be easily accumulated on the upper surface of the match plate due to its weight when the compressed air is escaped from the upper molding box. Since the compressed air cannot go through the match plate having the molding portions, the compressed air must escape through the side wall of the lower molding box and a squeeze table located therebeneath. Accordingly, accumulation of the molding sand progresses on the side wall of the lower molding box and the squeeze table.

However, an air curtain may be formed on the under surface of the match plate and therefore the molding sand cannot be easily accumulated on the under surface of the molding portions of the the match plate and its accumulation cannot be precisely carried out.

Further, since the compressed air escapes from the lower molding box, the molding sand tends to fall with its weight. Therefore, it is very difficult to accumulate the molding sand on the under surface of the molding portions of the match plate. For the above reasons, molding of the lower molding box could not be done well in the conventional machine.

SUMMARY OF THE INVENTION

An object of this invention is to solve the above mentioned problems and to precisely form a mold in upper and lower molding boxes with sand shot.

To achieve the above mentioned object, the molding machine according to the present invention comprises an upper molding box provided movably in vertical directions; said upper molding box having a plurality of exhaust holes through the inside walls, thereof, driving means for driving the upper molding box, a lower molding box provided movably in vertical directions with respect to the upper molding box; said lower molding box having a plurality of exhaust holes through the inside walls thereof, driving means for driving the lower molding box, a match plate provided with molding portions and arranged to move in a sandwiched state between the upper and lower molding boxes and move out of the sandwiched state in lateral directions, shot means for shooting a molding sand into each of the upper and lower molding boxes from the side thereof with compressed air, pressing means for punching out a mold in the upper and lower molding boxes, elevating means for lifting and lowering the mold in the upper and lower molding boxes; said elevating means being provided with a squeeze table for forming a bottom wall of the lower molding box and supporting the mold and said squeeze table being provided with a plurality of air blow holes, and auxiliary blow means for blowing an air upwardly through the air blow holes of the squeeze table at the time of sand shot.

Therefore, when sand shot is carried out while the match plate having the molding portions is sandwiched between the upper and lower molding boxes, the molding sand shot into the lower molding box is blown upwardly by means of the air blown from the air blow holes of the squeeze table though it tends to fall down due to its weight.

As the molding sand flows into the lower molding box, sand accumulates evenly across and on the underside of the match plate. Accordingly, an air curtain is almost never formed on the under surface of the molding portions of the match plate, which air curtain is formed in the conventional machine.

As the result, it becomes possible to completely accumulate the molding sand on the under surface of the lower molding portions of the match plate so as to form a fine mold both in the upper and lower molding boxes even if the mold is deeply grooved.

A seal made of resilient material such as rubber is provided around the sides of the squeeze table to be detachable in order to increase airtightness for the upper and lower molding boxes when the molding sand is shot under pressure. However, the seal tends to expand upward as connection between the seal and the squeeze table releases for a long term of use. As the result, when it is tried to push out the mold formed on the squeeze table, the bottom surface of the mold engages with the seal rised from the squeeze table. Therefore, the mold does not slide smoothly on the squeeze table and sometimes it is broken. Further, rising of the seal reduces a sealing effect between the squeeze table and the lower molding box.

The second object of the present invention is to smoothly push a mold on the squeeze table and to keep a sealing effect between the sides of the squeeze table and the lower molding box for a long time.

Other object and advantages of the present invention will be apparent from the description of the embodiment with reference to the drawings.

BRIEF DESCRIPTION OF THE DRAWINGS

The drawings show an embodiment of a molding machine according to the present invention in which.

DETAILED DESCRIPTION OF THE EMBODIMENT

Figure 1:
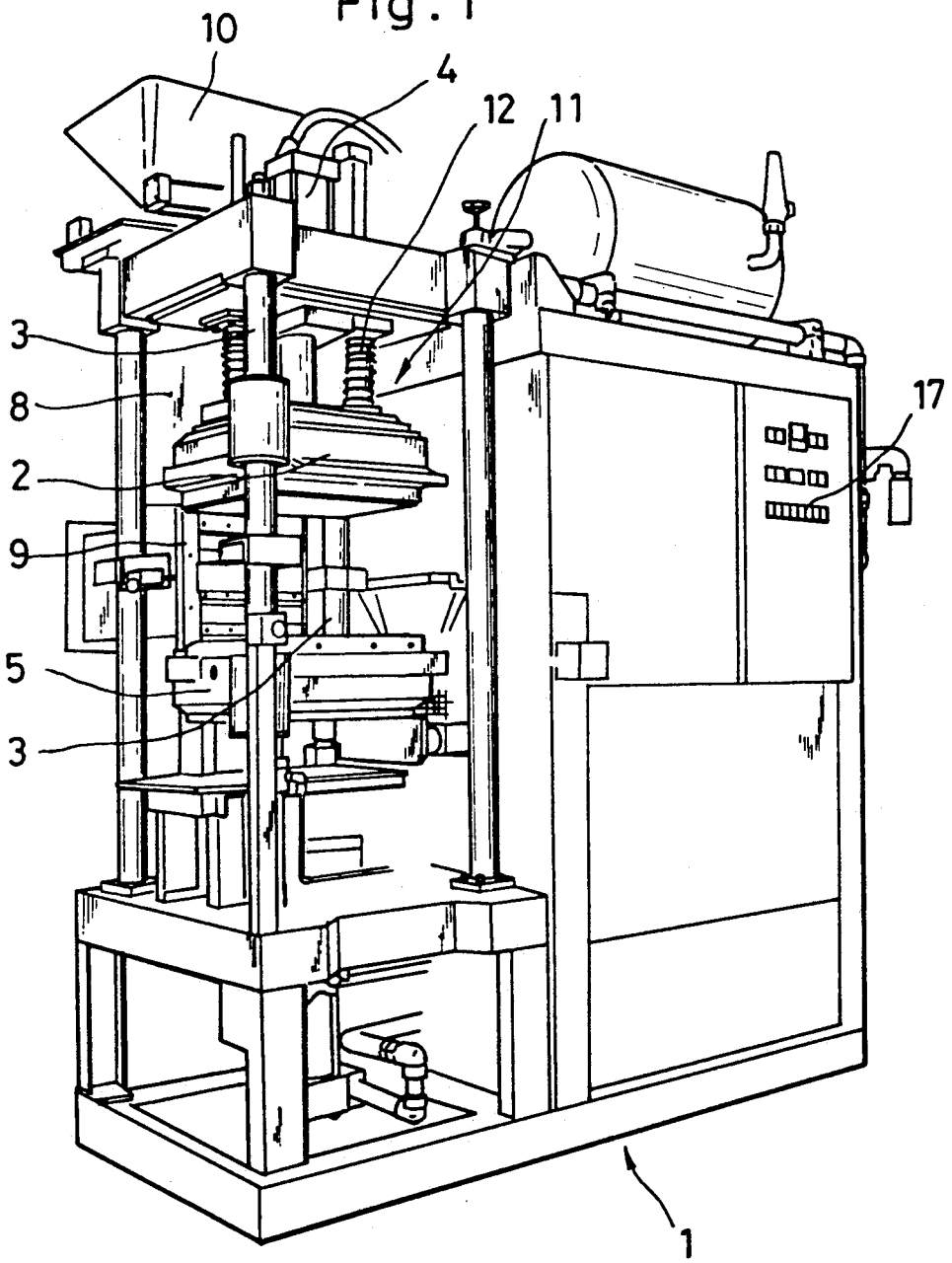
FIG. 1 is a perspective view of the molding machine.

FIG. 1 shows a molding machine body 1 and the machine body 1 is provided with an upper molding box 2 which is guided by means of a pair of guide poles 3, which are arranged diagonally, so as to be movable in vertical direction. 4 indicates an oil cylinder which comprises driving means for driving the upper molding box 2 in vertical directions.

5 is a lower molding box which is arranged to be movable in vertical directions with respect to the upper molding box 2.

Figure 2:
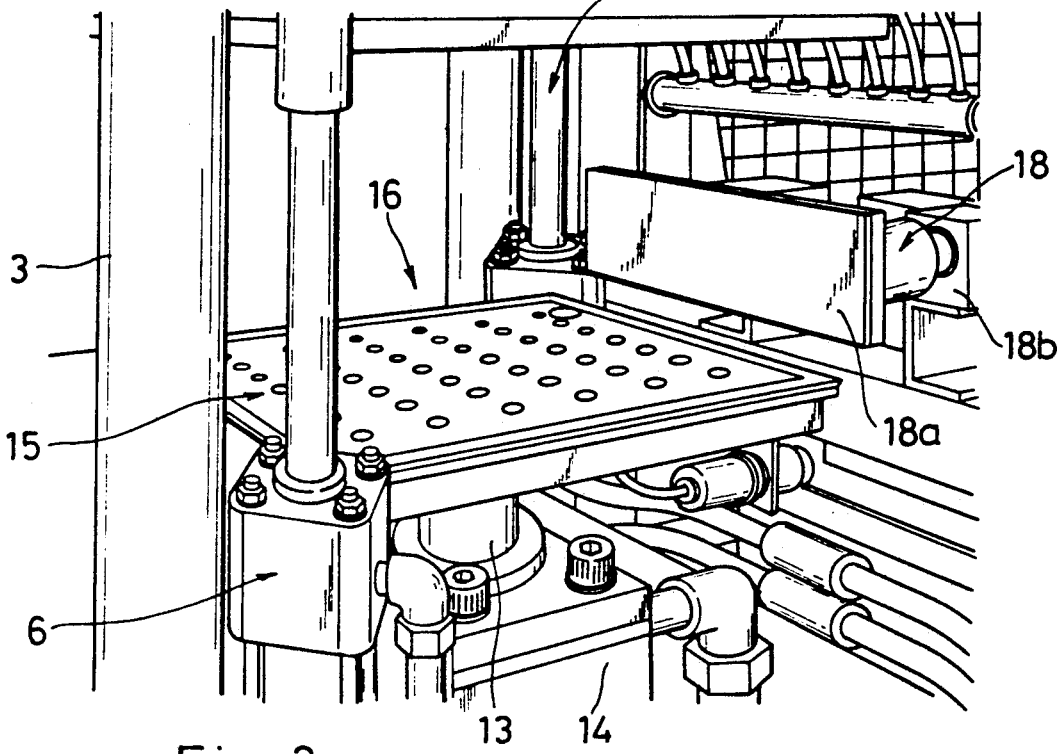
FIG. 2 is a perspective view of an essential portion around a squeeze table.
Figure 3:
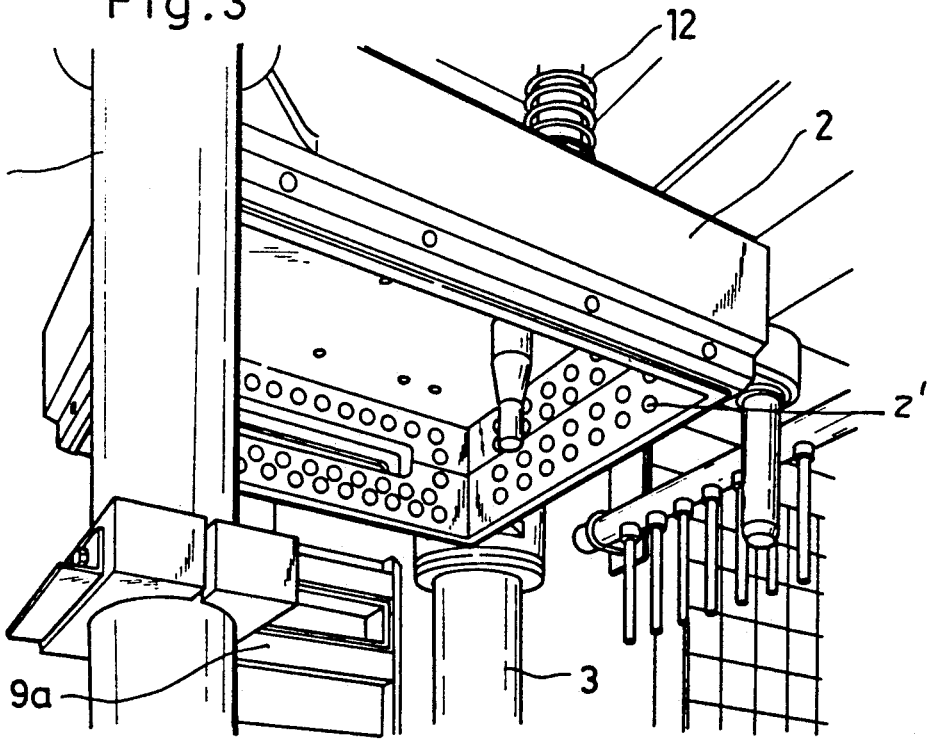
FIG. 3 is a perspective view of an upper molding box.

As shown in FIG. 2, the lower molding box 5 is driven vertically by means of oil cylinders 6 as driving means therefor.

Figure 4:
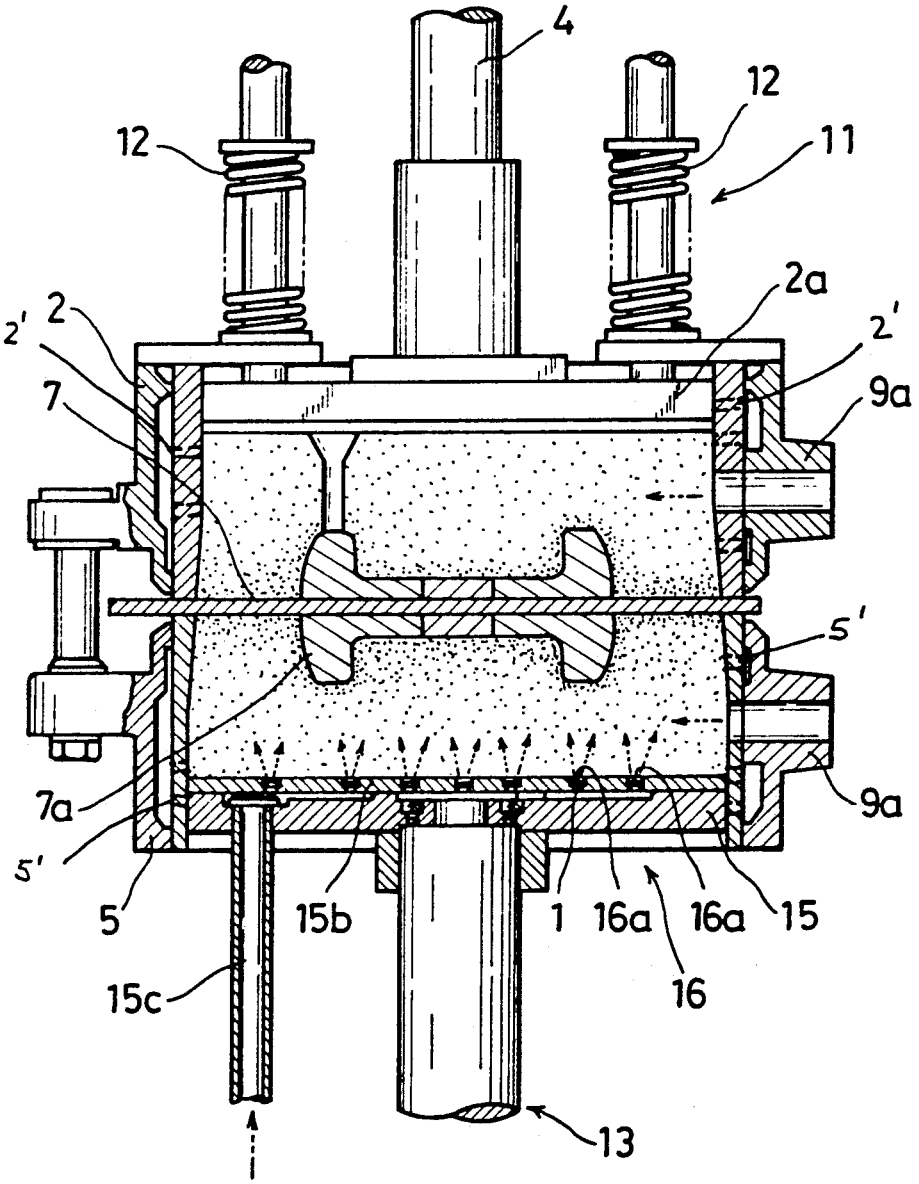
FIG. 4 is a vertical sectional view of an essential portion thereof.
Figure 7:
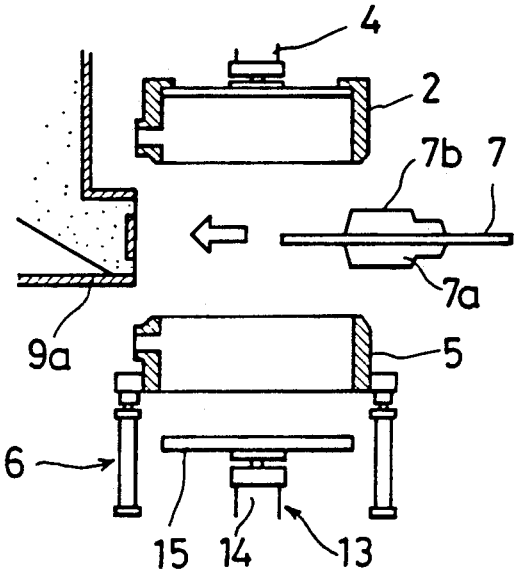
FIGS. 7*a* through 7*h* are vertical sectional views showing molding steps.
Figure 7:
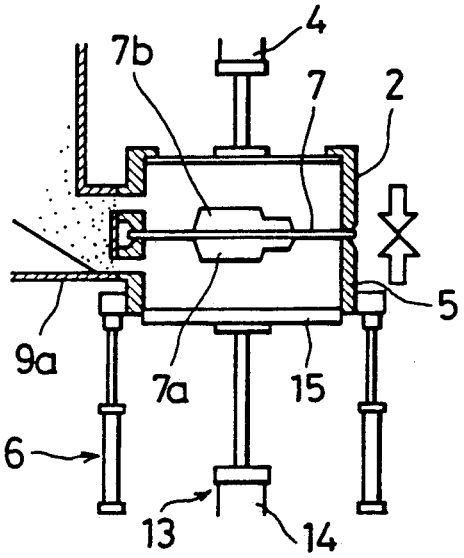
Figure 7:
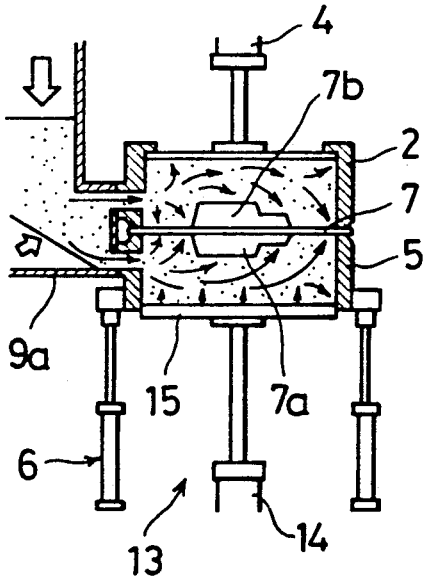
Figure 7:
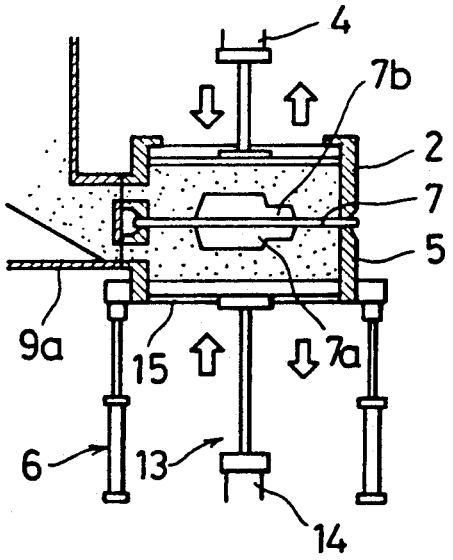
Figure 7E:
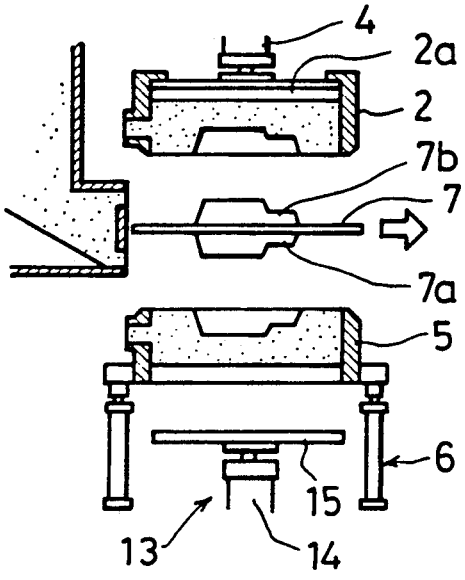
Figure 7F:
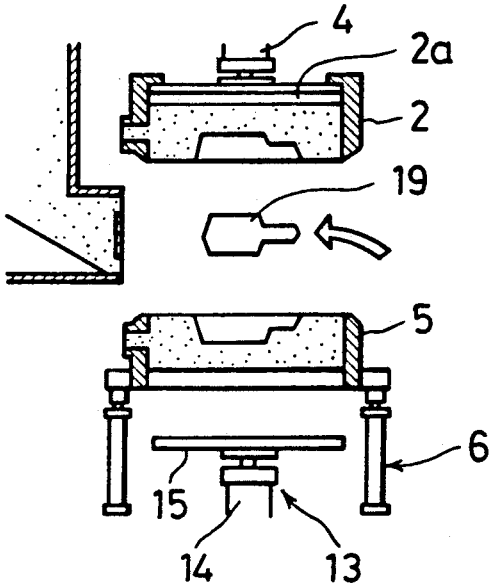
Figure 7G:
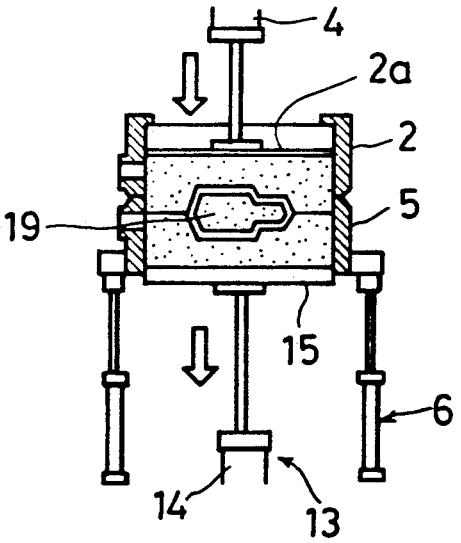
Figure 7H:
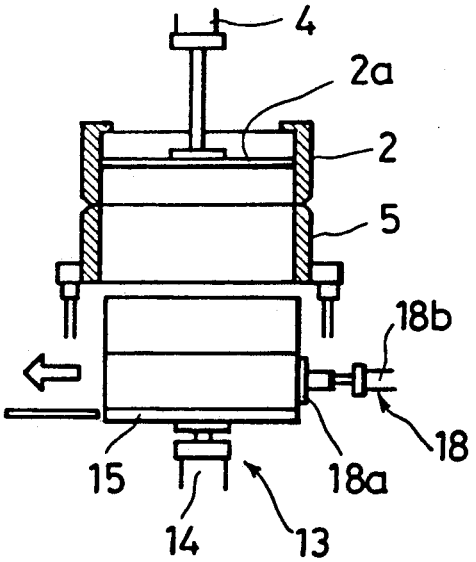

7 denotes a match plate having molding portions 7*a* and 7*b*, as shown in FIGS. 4 and 7. The match plate 7 is driven by means of an air cylinder (not shown) as driving means to move in a sandwiched state between the upper and lower molding boxes 2 and 5 and move out of the sandwiched state in lateral directions.

9 shows shot means for shooting or injecting a molding sand into the upper and lower molding boxes 2 and 5 from the sides thereof with compressed air. The shot means comprises a blow head 9*a*, blow tank 8, a molding sand hopper 10 and an air compression means including an air compressor and a tank. The construction of the shot means belongs to a conventional art and therefore it is not described in detail herein.

A number of air exahust holes 2' and 5' are formed with the inside wall of each of the upper and lower molding boxes 2 and 5 for exhausting only air. The air shot from the blow head 9*a* together with the molding sand, is exhausted out of the upper and lower molding boxes 2 and 5 through the air exhaust holes 2' and 5'.

11 denotes pressing means for pushing down or punching out a mold downwardly which is formed in the upper and lower molding boxes 2 and 5. The pressing means 11 mainly comprises the oil cylinder 4 and an upper plate 2*a* which forms an upper wall of the upper molding box 2. Therefore, the oil cylinder 4 is utilized for elevating the upper molding box 2 and puching out the mold.

A compression spring 12 is interposed between the upper plate 2*a* and a part of the machine body 1 so as always to press the upper plate 2*a* downwardly. The pressing means 11 per se is well known in the art of this field and therefore it is not referred to in detail herein.

13 is elevating means for lifting and lowering a mold formed in the upper and lower molding boxes 2 and 5. The elevating means 13 comprises mainly an oil cylinder 14 and a squeeze table 15 which is provided with an end of a rod of the oil cylinder 14 in order to form a bottom wall of the lower molding box 5 and support the mold and press same upwardly.

16 denotes auxiliary blow means for blowing air upwardly from the squeeze table 15 located beneath the lower molding box 5. The auxiliary blow means 16 will be described in detail with reference to FIGS. 4 through 6.

Figure 6:
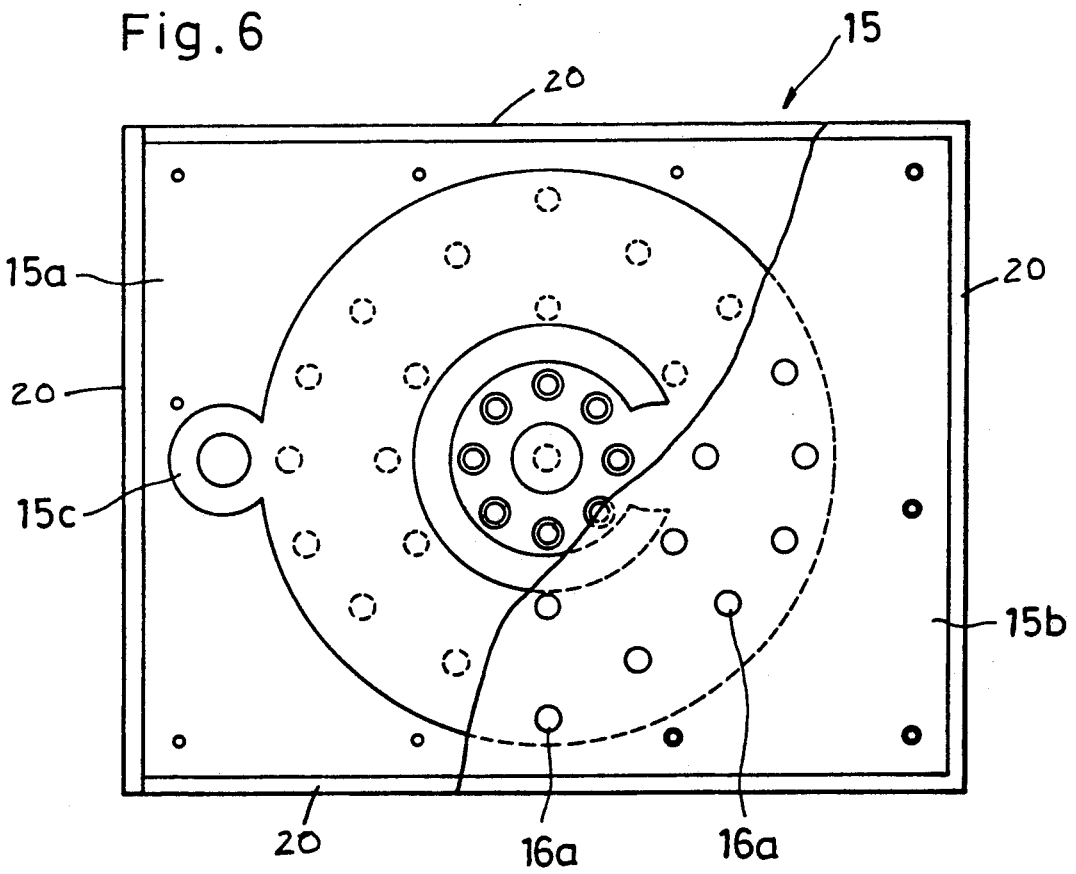
FIG. 6 is a plan view of the squeeze table partly broken away.

The squeeze table 15 comprises a table plate 15*a* and a table liner 5*b* which is arranged on the upper surface of the table plate 15*a*. An air passage R is formed between the table plate 15*a* and the table liner 15*b* and the air passage R is connected to an air pipe 15*c* which is connected to an air tank (not shown). Compressed air is accumulated in the air tank under predetermined pressure by means of an air compressor of the machine body 1. A number of air blow holes 16*a* are formed with the table liner 15*b* leaving a predetermined distance thereamong and each of the air blow holes 16*a* is communicated with the air passage R. Such blow holes 16*a* are arranged in a pattern of generally concentric circles as shown in FIG. 6. Air blow of the auxiliary blow means 16 is carried out simultaneously with the above mentioned sand shot. The air pressure blow by the auxiliary blow means is controlled preferably between 1.5 and 3.0 atmospheres.

The operations of the auxiliary blow means 16, the upper and lower molding boxes 2 and 5 and molding steps may be controlled by automatic control means 17 which is provided with the machine body 1. The automatic control means 17 is such a type that it belongs to the conventional art in the field of automatic control systems and does not include any novel technique and therefore it is not described in detail herein.

18 shows a forwarding mechanism constructed to actuate in lateral direction so as to laterally transfer the mold after the mold is punched out from the upper and lower molding boxes 2 and 5. The forwarding mechanism 18 comprises a pushing plate 18*a* and an oil cylinder 18*b* for driving the pushing plate 18*a*.

Figure 8:
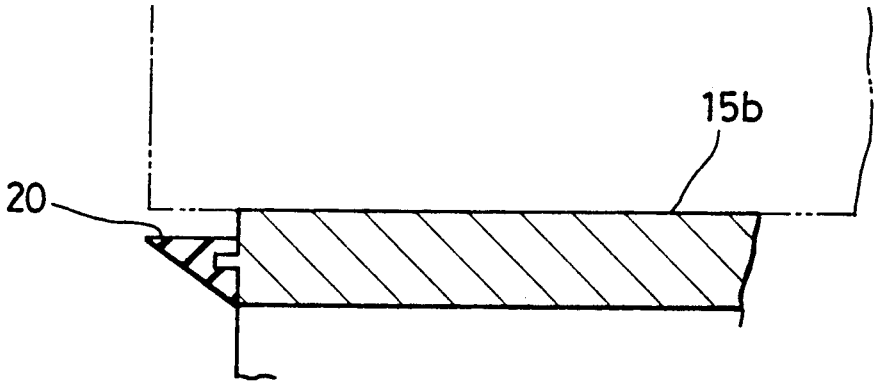
FIG. 8 is vertical sectional view of the squeeze table partly enlarged.

FIG. 8 is a vertical sectional view showing a part of the squeeze table 15 which is enlarged, and a seal 20 made of rubber is provided around the sides or periphery of the squeeze table 15. That is, as shown in FIG. 6, the seal 20 extends entirely around the perimeter of the squeeze table 15. The cross-section shape of the seal 20 located at the top, right side and bottom of table 15 (as seen in FIG. 6) is generally square or rectangular.

Figure 5:
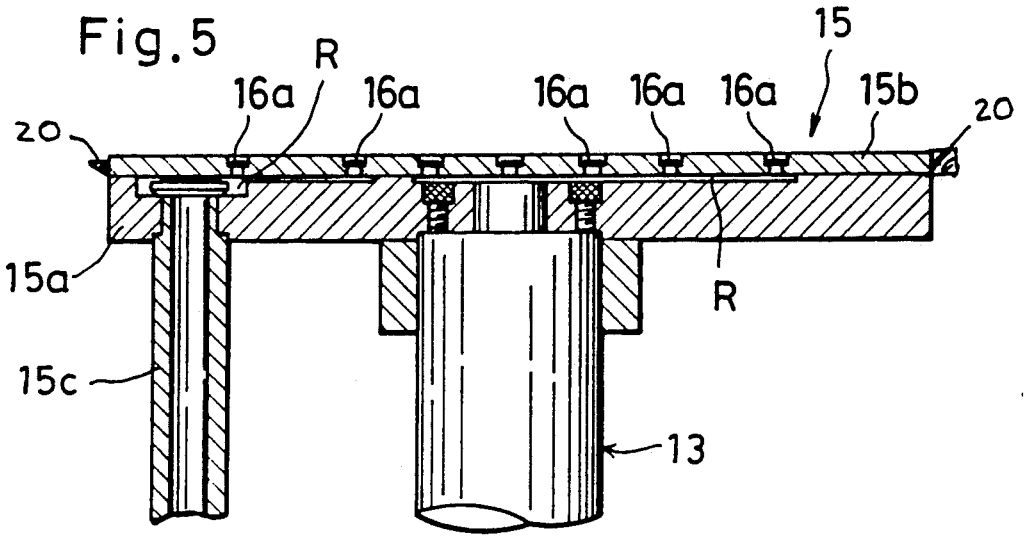
FIG. 5 is a vertical sectional view of the squeeze table.

As best seen in FIGS. 2 and 5, the upper surface of that portion of the seal 20 opposite the pushing plate 18*a* (i.e., that portion at the left as seen in FIGS. 5 and 6) has its top surface lowered slightly from the upper surface of the table liner 15*b* so as to define a step. The preferred cross-section shape of such seal portion is generally triangular although other shapes may be used. With the step construction of the seal 20, peeling force hardly acts on the upper surface of the seal 20 when the mold is pushed across the table liner 15*b*. In other words, such placement of seal 20 and its slightly-lowered upper surface helps avoid damage to such portion as the mold is pushed laterally from machine body 1. Further, even if an end of the seal 20 expands slightly as its attachment is released for a long time of use, the bottom surface of the mold would not engage with the seal 20.

Therefore, sealing may be maintained effectively between the seal 20 and the lower molding box 5 for a long time and it becomes possible to forward the mold smoothly.

Next, molding steps will be described with reference to FIGS. *7a* through *7h*.

As shown in FIG. *7a*, the match plate 7 having predetermined molding portions *7a* and *7b*, is moved laterally and positioned in a sandwiched state between the upper and lower molding boxes 2 and 5.

Then, as shown in FIG. *7b*, the upper and lower molding boxes 2 and 5 are brought close to each other in vertical directions so as to sandwich the match plate 7.

As shown in FIG. *7c*, a molding sand is shot into each of the upper and lower molding boxes 2 and 5 via the blow head *9a*. At the same time, compressed air is blown into the lower molding box 5 through the air blow holes *16a* by means of the auxiliary blow means 16, and then the molding sand in the lower molding box 5 may flow and equivalently accumulate on the side of the match plate 7. Using the function of the auxiliary blow means 16, one may easily obtain good accumulating conditions of the molding sand for the molding portions *7a* of the under surface of the match plate 7. In the upper molding box 2, since the upper molding portions *7b* is located in the falling direction of the molding sand due to its weight, satisfactory accumulation of the molding sand may of course be obtained without any problem.

The air blown from the blow head *9a* is exhausted out through the exhausting holes 2' and 5' of the inside walls of the upper and lower molding boxes 2 and 5.

As shown in FIG. *7d*, when sand shot is finished, the molding sand in the upper and lower molding boxes 2 and 5 is compressed strongly in vertical directions, and it is very effective to carry out air blow by means of the auxiliary blow means 16 in synchronism with a time overlapping the beginning of the compression step in order to increase fineness and precision of the mold. Next, the upper and lower molding boxes 2 and 5 are moved away from each other in vertical directions with the match plate 7 as the central figure.

As shown in FIG. *7e*, the match plate 7 is moved laterally and removed from the sandwich state between the upper and lower molding boxes 2 and 5.

Next, as shown in FIG. *7f*, a predetermined core 19 is set in the mold of the lower molding box 5.

As shown in FIG. *7g*, the upper and lower molding boxes 2 and 5 are moved to be in contact with each other and then the upper and lower molds are punched out downwardly from the upper and lower molding boxes 2 and 5 while supporting the molds by the squeeze table 15. Finally, as shown in FIG. *7h*, the pushing plate *18a* is forwarded by means of the oil cylinder *18b* so as to laterally transfer the mold from the molding machine 1.

In the above mentioned molding steps, the core 19 is used. However, the molding step of FIG. *7f* may be omitted where the core 19 is not necessary.

What is claimed is:

1. An improved molding machine comprising:

an upper molding box movable in vertical directions and having a plurality of exhaust holes formed in the inside walls thereof;

driving means for driving the upper molding box;

a lower molding box movable in vertical directions with respect to the upper molding box; said lower molding box having a plurality of exhaust holes formed in the inside walls thereof;

driving means for driving the lower molding box, a laterally movable match plate provided with molding portions and arranged to be clamped between the upper and lower molding boxes;

shot means for introducing molding sand and compressed air into each of the upper and lower molding boxes from the side thereof;

pressing means for punching out a mold in the upper and lower molding boxes;

elevating means for lifting and lowering the mold in the upper and lower molding boxes, said elevating means being provided with a squeeze table for forming a bottom wall of the lower molding box and supporting the mold, said squeeze table being provided with a plurality of air blow holes arranged in a pattern of generally concentric circles;

auxiliary blow means for blowing air through the air blow holes of the squeeze table and only into the lower box as the squeeze table moves toward the match plate, the auxiliary blow means including a table liner having air blow holes, a table plate and an air passage formed between the table liner and the table plate;

a seal around the periphery of the table liner wherein the upper surface of that portion of the seal across which the mold is laterally transferred is lowered slightly from the upper surface of the table liner so as to form a step thereby preventing the mold from engaging the seal as the mold is laterally transferred from the machine.

2. The machine of claim 1 wherein that portion of the seal across which the mold is laterally transferred is generally triangular in shape.

3. A molding machine comprising:

an upper molding box movable in vertical directions and having a plurality of exhaust holes formed in the inside walls thereof;

driving means for driving the upper molding box;

a lower molding box movable in vertical directions with respect to the upper molding box, said lower molding box having a plurality of exhaust holes formed in the inside walls thereof;

driving means for driving the lower molding box;

a laterally movable match plate provided with molding portions and arranged to be clamped between the upper and lower molding boxes;

shot means for introducing molding sand and compressed air into each of the upper and lower molding boxes from the side thereof;

pressing means for punching out a mold in the upper and lower molding boxes;

elevating means for lifting and lowering the mold in the upper and lower molding boxes, said elevating means being provided with a squeeze table for forming a bottom wall of the lower molding box and supporting the mold;

said squeeze table including a plurality of air blow holes arranged in a pattern of generally concentric circles;

said squeeze table further including a table liner having air blow holes and a seal about its periphery wherein the upper surface of that portion of the seal across which the mold is laterally transferred is lowered slightly from the upper surface of the table liner so as to form a step thereby preventing the mold from engaging such seal as such mold is laterally transferred from the machine; and, auxiliary blow means for blowing air through the air blow holes of the squeeze table and only into the lower box as such squeeze table moves toward the match plate, such auxiliary blow means including a table plate and an air passage between the table liner and the table plate.

* * * * *

UNITED STATES PATENT AND TRADEMARK OFFICE

CERTIFICATE OF CORRECTION

PATENT NO. : 5,125,449

DATED : June 30, 1992

INVENTOR(S) : Shozo Asao

It is certified that error appears in the above-identified patent and that said Letters Patent is hereby corrected as shown below:

In column 3, line 22 after "is", insert --a--.

In column 4, line 19 delete "5b" and insert --15b--.

Signed and Sealed this

Twenty-fourth Day of August, 1993

*Attest:*

BRUCE LEHMAN

*Attesting Officer*

*Commissioner of Patents and Trademarks*